US006551214B1

(12) United States Patent
Taimela

(10) Patent No.: US 6,551,214 B1
(45) Date of Patent: Apr. 22, 2003

(54) APPARATUS FOR EXERCISE AND REHABILITATION OF THE MUSCLES AROUND THE CERVICAL SPINE AND/OR THE MOTIONAL PATTERN OF THE CERVICAL SPINE VIA ROTARY TRAINING MOTION OF THE HEAD

(75) Inventor: Simo Taimela, Vantaa (FI)

(73) Assignee: DBC International, Vantaa (FI)

( * ) Notice: Subject to any disclaimer, the term of this patent is extended or adjusted under 35 U.S.C. 154(b) by 0 days.

(21) Appl. No.: 09/582,983

(22) PCT Filed: Dec. 28, 1998

(86) PCT No.: PCT/FI98/01025

§ 371 (c)(1),
(2), (4) Date: Jul. 10, 2000

(87) PCT Pub. No.: WO99/34878

PCT Pub. Date: Jul. 15, 1999

(30) Foreign Application Priority Data

Jan. 9, 1998 (FI) ..... 980039

(51) Int. Cl.[7] ..... A63B 23/025

(52) U.S. Cl. ..... 482/10; 482/100; 482/136; 482/142; 601/25; 601/39

(58) Field of Search ..... 482/10, 11, 100, 482/135, 136, 139; 601/25, 39; 73/379.01

(56) References Cited

U.S. PATENT DOCUMENTS

| | | | | |
|---|---|---|---|---|
| 4,278,249 A | * | 7/1981 | Forrest | 482/10 |
| 4,655,450 A | | 4/1987 | Rogers, Jr. et al. | |
| 4,733,859 A | | 3/1988 | Kock et al. | |
| 4,768,779 A | | 9/1988 | Oehman, Jr. et al. | |
| 4,893,808 A | | 1/1990 | McIntyre et al. | |
| 5,092,584 A | * | 3/1992 | Jones | 482/10 |
| 5,118,098 A | | 6/1992 | Jones | |
| 5,324,247 A | * | 6/1994 | Lepley | 482/136 |
| 5,336,138 A | | 8/1994 | Arjawat | |
| 5,360,383 A | | 11/1994 | Boren | |
| 5,997,440 A | * | 12/1999 | Hanoun | 482/10 |

FOREIGN PATENT DOCUMENTS

| | | | | |
|---|---|---|---|---|
| FR | 2661333 | * 10/1991 | | 482/10 |
| WO | WO 92/01276 | * 1/1992 | | 601/39 |

* cited by examiner

*Primary Examiner*—Jerome W. Donnelly
*Assistant Examiner*—Victor K. Hwang
(74) *Attorney, Agent, or Firm*—Young & Thompson

(57) ABSTRACT

Apparatus for exercising the muscles around the cervical spine and/or the motional pattern of the cervical spine with a rotation exercise movement of the head, said apparatus comprising an equipment frame (1), a turning arbor (2) mounted on the equipment frame with bearings permitting rotation of the arbor about a vertical axis, a head rest element (3) for holding the head, said head rest element being connected to the turning arbor (2) and comprising means for holding the head of the person performing the exercise movement substantially immobile in the head rest element. The apparatus comprises a turning device (4) connecting the head rest element (3) to the turning arbor (2) so as to allow simultaneous turning of the head rest element about three axes perpendicular to each other, and a control gear (5) arranged to control the turning of the head rest element (3) so that the head rest element turns about said axes in a predetermined proportion to the angle of rotation of the turning arbor (2) so that the path of the head rest element corresponds to the natural three-dimensional motional pattern of head rotation.

14 Claims, 8 Drawing Sheets

APPARATUS FOR EXERCISE AND REHABILITATION OF THE MUSCLES AROUND THE CERVICAL SPINE AND/OR THE MOTIONAL PATTERN OF THE CERVICAL SPINE VIA ROTARY TRAINING MOTION OF THE HEAD

CROSS REFERENCE TO RELATED APPLICATION

This is the 35 USC 371 national stage of international application PCT/FI98/01025 filed on Dec. 28, 1998, which designated the United States of America.

BACKGROUND OF THE INVENTION

Most of the movements of the joints and especially limbs of the human body are based on a structure in which a tubular bone is joined to another tubular bone via a so-called hinge joint. The movement resembles the action of a mechanical hinge and takes place mainly two-dimensionally about a pivot point with a constant radius. An example of such movement is that of the elbow joint. However, the action of a hinge joint is not quite as simple as this, but this is the basic principle.

The action of the spine is not as simple as this. The spinal column consists of vertebrae and disks between them. Adjacent vertebrae are joined together via the disk and so-called facet joints. Successive vertebrae and the disk between them are called a functional spine unit (FSU). The movements of the spine cannot be described on the principle of the hinge joint, but the FSU always works in a three-dimensional fashion, comprising both rotation and sliding in different directions of motion.

FIG. 1 presents a model of a pair of spinal vertebrae $C_1$ and $C_{1-1}$ with a three-dimensional xyz-coordinate system focused in the centre of the upper vertebra $C_1$ in the pair of vertebrae. The x-direction here means the direction corresponding to the frontal direction of a person, i.e. the direction in which the front side of the body faces. The y-direction means a lateral direction which is horizontal and perpendicular to the x-direction. The z-direction means a vertical direction perpendicular to the xy-plane. It can be seen from FIG. 1 that there may be a total of 12 load components, linear and rotatory, acting via these axes. The application of a load to any one of the axes produces a displacement of the upper vertebra $C_1$ relative to the lower vertebra $C_{1-1}$. The displacement is the sum of rotation and sliding in the directions of motion.

As early as in the 1960's it was established in experimental research that rotatory (axial rotation) and lateral effects in the FSU mechanism are interlinked; reference is made to a phenomenon called 'coupling movement patterns' (Soobey JR.: Motion testing of the cervical spine. J. Amer Oseopath Ass 1967; 66:381; Lysell E: Motion in the cervial spine. Acta Orthop Scan 1969; Suppl. 123:1; White AM & Panjabi M: The basic kinematics of the human spine 1978; 3:13 and White AM & Panjabi M: Clinical Biomechanics of the Spine. Lippincott, Philadelphia, 1978). This also means that, in spinal movements, lateral flexion and rotation tend to occur simultaneously. Accordingly, in free spinal movements there appears no single-plane motion or motion about a single fulcrum. In movements in the lower part of the spine, deviations between two-dimensional and natural motion are smaller than in the cervical spine, where combined movement patterns are ostensibly significant.

In FIG. 2, a person is depicted diagrammatically in front view while FIG. 3 shows the same person in side view. In the figures, the sketch in heavier lines depicts a neutral position of the head, whereas the sketch in lighter lines shows the position of the head after rotation toward the left. FIGS. 2 and 3 illustrate the fact that rotation also involves simultaneous sideways tilting of the head in the direction of the rotation as well as an inclination forward. Thus, the cervical spine follows a three-dimensional pattern of motion.

In prior art, a rotation exercise apparatus is known which comprises an equipment frame, a turning arbor mounted on the equipment frame so as to permit rotation about a vertical axis, and a head rest element designed to hold the head and connected to the turning arbor.

A problem with the prior-art apparatus is that it only implements an exclusively linear or two-dimensional movement pattern, which means that the motion of the cervical spine does not follow a natural path. As stated above, the cervical spine in fact follows a three-dimensional movement pattern. Therefore, when head rotation exercises are done using this prior-art apparatus, an incorrect movement pattern is learned and the incorrectly applied stress may involve a risk of injury.

SUMMARY OF THE INVENTION

The object of the present invention is to eliminate the above-mentioned drawbacks. A specific object of the present invention is to disclose an apparatus having a head rest element that implements a natural three-dimensional motional pattern so that a correct three-dimensional path of the cervical spine can be learned using the apparatus and that the apparatus allows exercise and rehabilitation of the muscles moving the cervical spine in a way permitting correct application of stress to them.

According to the invention, the head rest element comprises means for holding the head of the person performing an exercising movement substantially immobile on the head rest element. The apparatus comprises a turning device connecting the head rest element to a turning arbor. The turning device allows simultaneous turning of the head rest element about three axes perpendicular to each other. Moreover, the apparatus comprises a control gear which controls the turning of the head rest element connected to the turning device as a function of the angle of rotation of the turning arbor so that the head rest element turns simultaneously about said axes in predetermined proportions corresponding to the natural three-dimensional motional pattern of head rotation.

When the head rest element is rotated about its vertical axis, the turning device allows a three-dimensional path for the head rest element so that simultaneous rotation about three axes perpendicular to each other takes place. When these motional degrees of freedom are interlinked by the control gear so that they occur in predetermined proportions to each other, the head rest element is caused to implement a three-dimensional motional pattern with rotation accompanied by lateral and forward inclination of the head. Thus, the invention has the advantage that the apparatus allows the exercise of movements along the natural three-dimensional path. The exercise can be performed with or without load. The advantages of a load on movements following the natural path are the following: During exercise, stress is correctly applied to those tissues to which it is intended to be applied. Furthermore, correct motional patterns are learned. This means that the motional patterns learned during exercises and rehabilitation are very likely to be correctly applied outside the exercise or rehabilitation situation as well. In addition, the risk of injury due to incorrect application of stress during exercise and rehabilitation is reduced.

In an embodiment of the apparatus, the apparatus comprises a seat provided with a back rest, holding means for holding a person's torson against the back rest, and adjusting elements for the adjustment of the position of the seat in relation to the equipment frame. Using the adjusting elements of the seat, a person can be individually seated in an accurate position relative to the equipment frame and the turning mechanism. In practice, the head rest element is at a certain height from the floor level, and in order to fit the head of the person sitting on the seat to the head rest element, the position and height of the seat are adjusted so that the head can be held by the head rest element.

In an embodiment of the apparatus, the head rest element is a helmet or the like which is capable of supporting the head from all sides. Therefore, the helmet has an interior space for receiving the head into it.

In an embodiment of the apparatus, the turning device comprises a first frame, which is attached to the turning arbor so that it turns with the turning arbor about a vertical first swing axis parallel to the z-axis. It is assumed that an xyz coordinate system is so attached to the turning arbor that the z-axis coincides with the first swing axis that the xy-plane turns with the turning arbor. Furthermore, the turning device comprises a second frame, which is pivotally mounted on the first frame so that it turns about a second swing axis parallel to the x-axis. In addition, the apparatus comprises a third frame, which is pivotally mounted on the second frame so that it turns about a third swing axis parallel to the y-axis, said third swing axis being disposed near the second swing axis perpendicularly to it. The head rest element is attached to the third frame. Thus, the head rest element can simultaneously turn about the vertical first swing axis, tilt sideways and perform a forward inclination.

In an embodiment of the apparatus, the first frame is arranged to extend downward and backward from the turning arbor to a point behind the head rest element so that it extends behind the neck of the person having his/her head in the head rest element. The second frame is pivotally mounted on said part of the first frame extending behind the head rest element, so that the second swing axis lies in the vertical centre plane of symmetry of the head rest element.

In an embodiment of the apparatus, the control gear comprises a first set of transmission elements for turning the second frame about the second swing axis parallel to the x-axis in relation to the first frame with a predetermined first transmission ratio when the turning arbor is turning about the first swing axis parallel to the z-axis.

In an embodiment of the apparatus, the control gear comprises a second set of transmission elements for turning the third frame about the third swing axis parallel to the y-axis with a predetermined second transmission ratio when the turning arbor is turning about the first swing axis parallel to the z-axis.

In an embodiment of the apparatus, the first set of transmission elements comprises a first turning element, e.g. a wheel or the like, which is attached to the turning arbor. A second transmission element, e.g. a wheel or the like, is attached to the second frame. A flexible elongated draw element is attached to the first and second turning elements to transmit the rotary motion of the turning arbor so as to turn the second frame with respect to the first frame.

In an embodiment of the apparatus, the second set of transmission elements comprises a projection attached to the turning arbor and extending in a substantially transverse direction from the turning arbor. A rocking arm is pivotally connected via a joint in its mid portion to the projection so that it can turn about a horizontal axis. The rocking arm comprises a front end, which is on the front side of the joint, and a rear end, which is on the rear side of the joint. Furthermore, the second set of transmission elements comprises a first rod, whose lower end is connected via a joint to the third frame and/or to the head rest element and whose upper end is connected via a joint to the rear end of the rocking arm. Moreover, the second set of transmission elements comprises a second rod, whose lower end is connected via a joint to the front end of the rocking arm and whose upper end is connected via a joint to the equipment frame.

In an embodiment of the apparatus, the first rod is connected to the third frame and/or head rest element and to the rocking arm via ball joints. The second rod is connected to the rocking arm and equipment frame via ball joints.

In an embodiment of the apparatus, the apparatus comprises a resistance means for producing a force opposing the rotation exercise movement.

In an embodiment of the apparatus, the resistance means is connected to the turning arbor to generate a torque opposing the rotation of the turning arbor.

In an embodiment of the apparatus, the resistance means works on the principle of gravitational resistance. The resistance means comprises a counterweight, which consists of a number of individual weight elements which can be combined to produce a predetermined load.

In an embodiment of the apparatus, the resistance means comprise a third wheel, which is connected to the turning arbor, and a flexible elongated second draw element for transmitting the load of the counterweight to the third wheel.

In an embodiment of the apparatus, the resistance means comprises an eccentric gear arranged to act between the second draw element and the counterweight so that a load opposing the exercise movement with a force varying in a predetermined manner as a function of the rotational angle of the turning arbor is created.

In an embodiment of the apparatus, the apparatus comprises adjustable limit stops for adjustment of the permitted range of exercise movement.

BRIEF DESCRIPTION OF THE DRAWINGS

In the following, the invention will be described in detail by the aid of a few preferred embodiments by referring to the attached drawing, wherein.

DETAILED DESCRIPTION OF THE INVENTION

Figure 1:
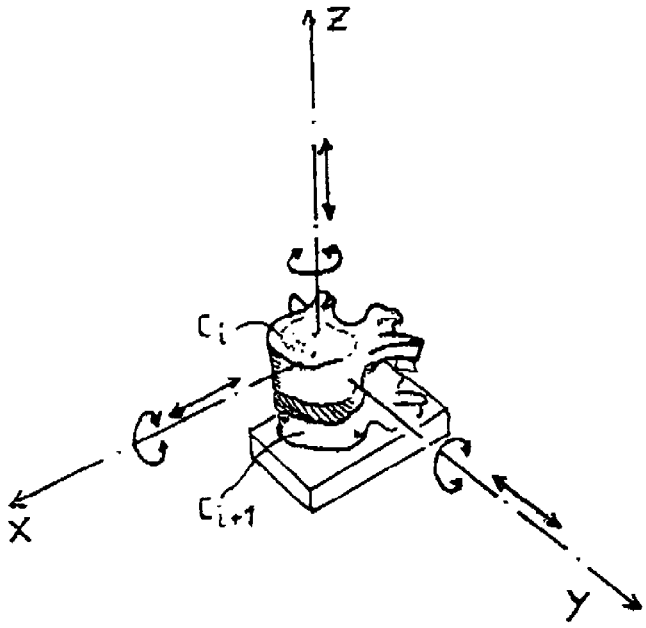
FIG. 1 presents a diagrammatic model of a pair of spinal vertebrae.
Figure 2:
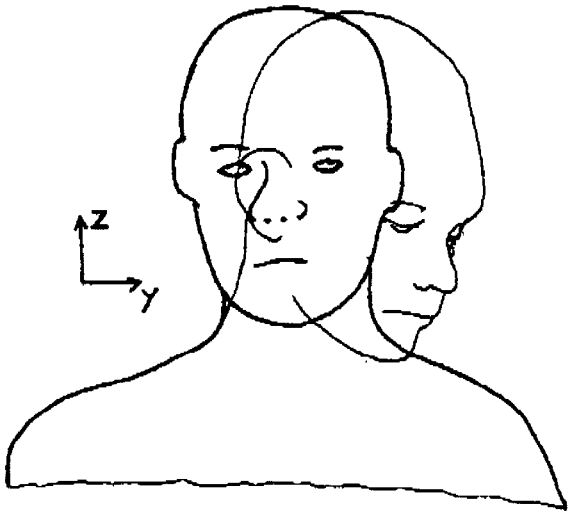
FIG. 2 presents a diagrammatic front view of a person with the head in a neutral position (heavier line) and in a turned position (lighter line)
Figure 3:
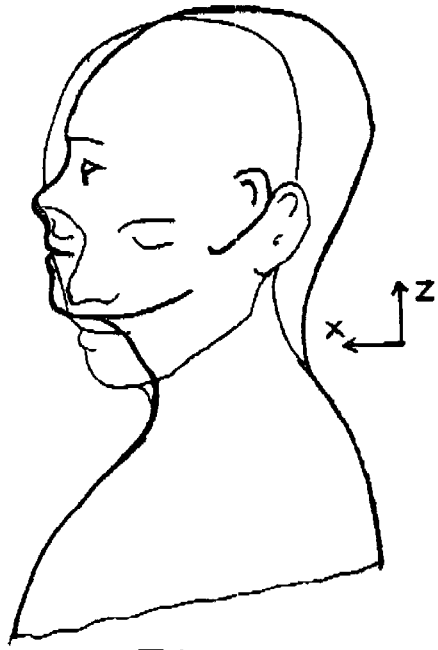
FIG. 3 presents the person in FIG. 2 in side view.
Figure 4:
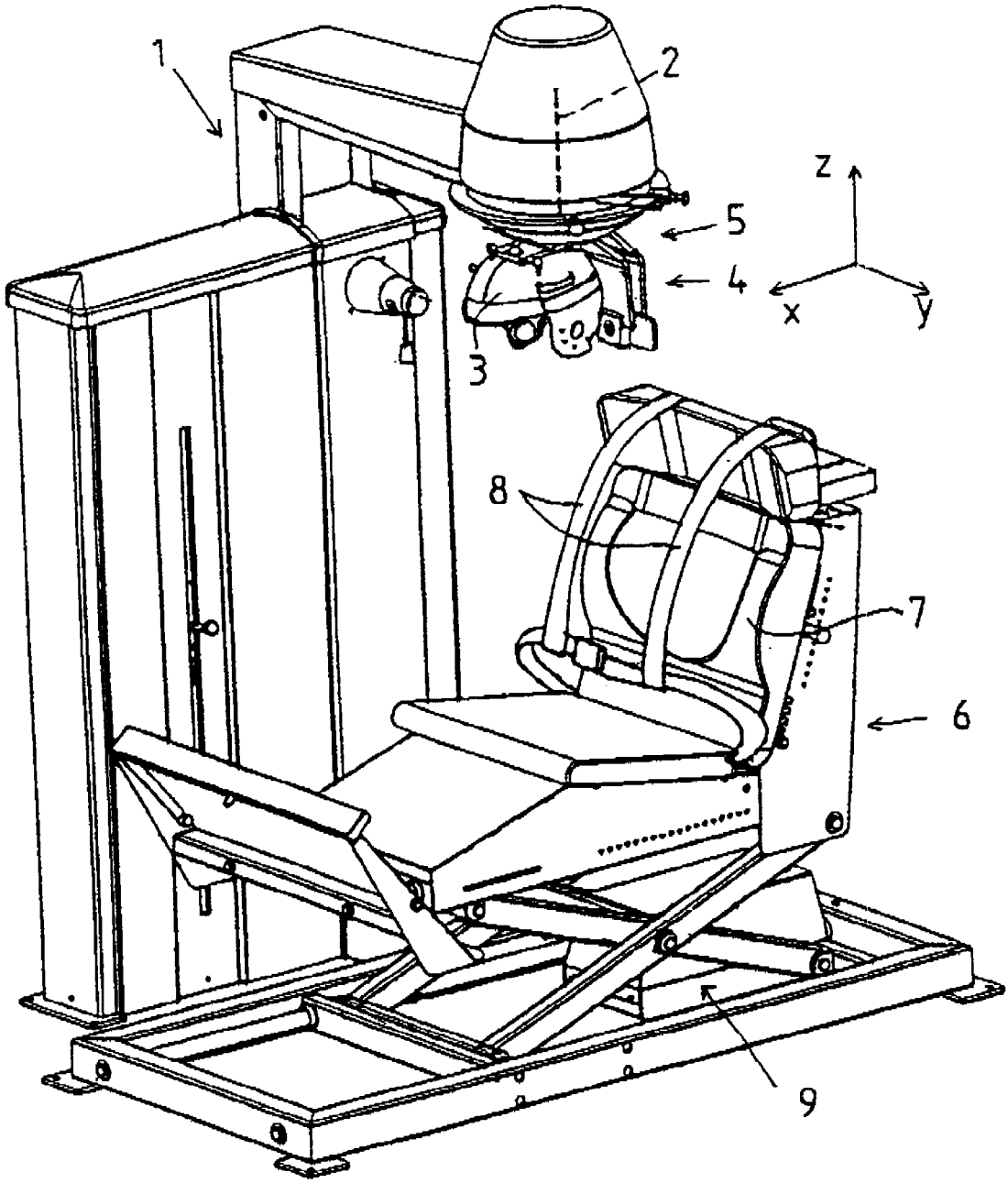
FIG. 4 presents an axonometric front view of an embodiment of the apparatus of the invention, seen obliquely from above.
Figure 5:
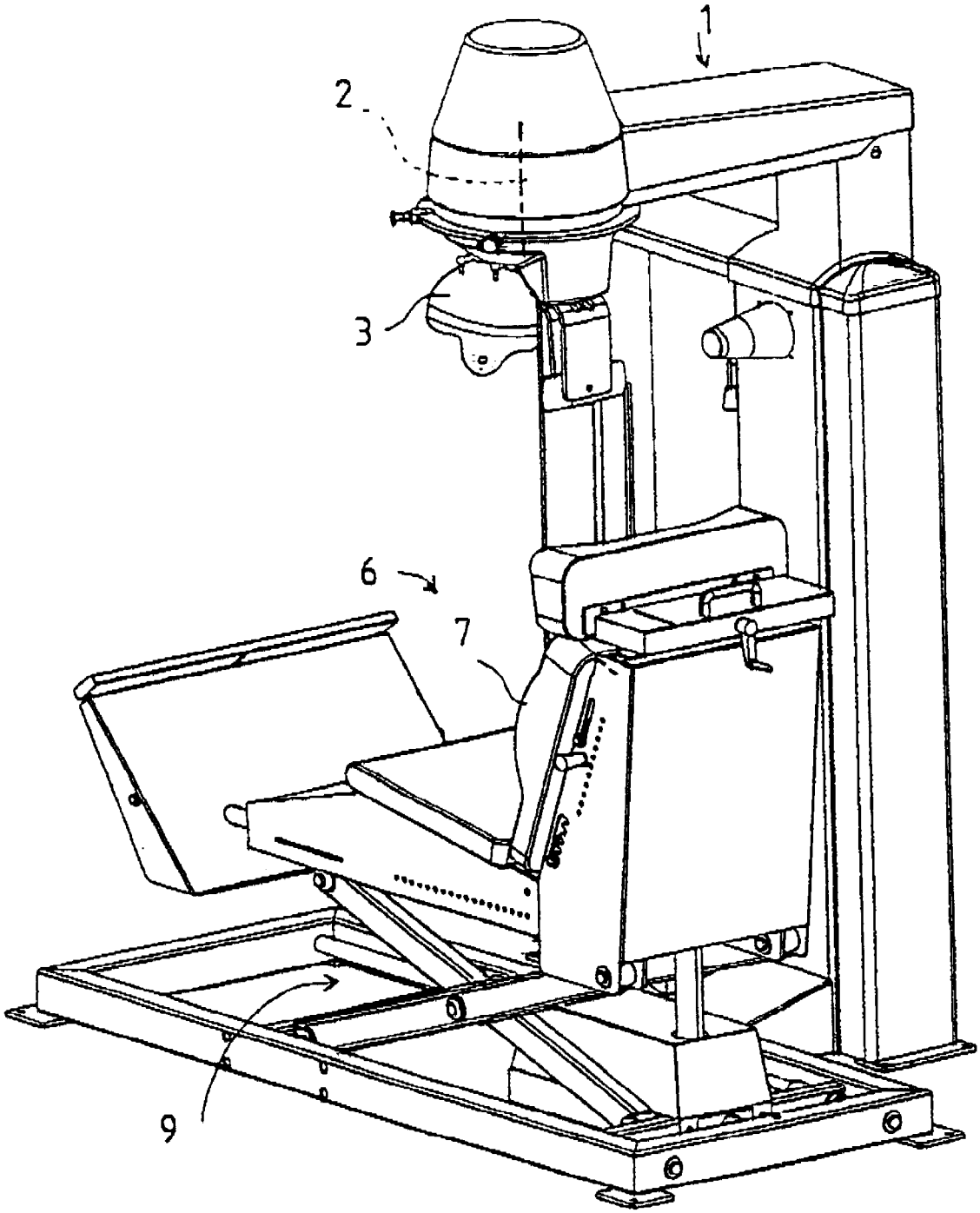
FIG. 5 presents the apparatus in FIG. 4 as seen obliquely from behind and above.

FIGS. 4 and 5 present an apparatus which can be used to perform rotatory cervical spine exercise movements intended to teach a person a correct three-dimensional motional pattern (FIGS. 2 and 3) of rotation of the cervical spine. In addition, by combining the motional pattern exercise with a load opposing the movement, the apparatus can be used to train the muscles participating in the rotation of the cervical spine.

The apparatus comprises an equipment frame 1 mounted on a floor and supporting the mechanism used to implement a three-dimensional motional pattern and a load opposing the rotation exercise. Placed beside the equipment frame 1 is a seat 6. The seat 6 comprises a seat part, a foot rest and a back rest 7. The seat is provided with a four-point seat belt 8, by means of which the torson of the person performing neck exercise is immovably tied to the back rest 7. To allow the person tied to the seat to be exactly correctly positioned with respect to the head rest element 3 and its turning and control mechanism, the seat is provided with versatile adjusting elements 9. Depicted in the figure is a coordinate system in which the x-direction corresponds to the sitting direction, the y-direction corresponds to a horizontal direction perpendicular to the x-direction, and the z-direction corresponds to the vertical direction. Using the adjusting elements 9, the seat 6 can be adjusted in the x and z directions. Practical implementation of the seat adjustments is part of the expertise of the skilled person, so it will not be described here in detail.

Figure 6:
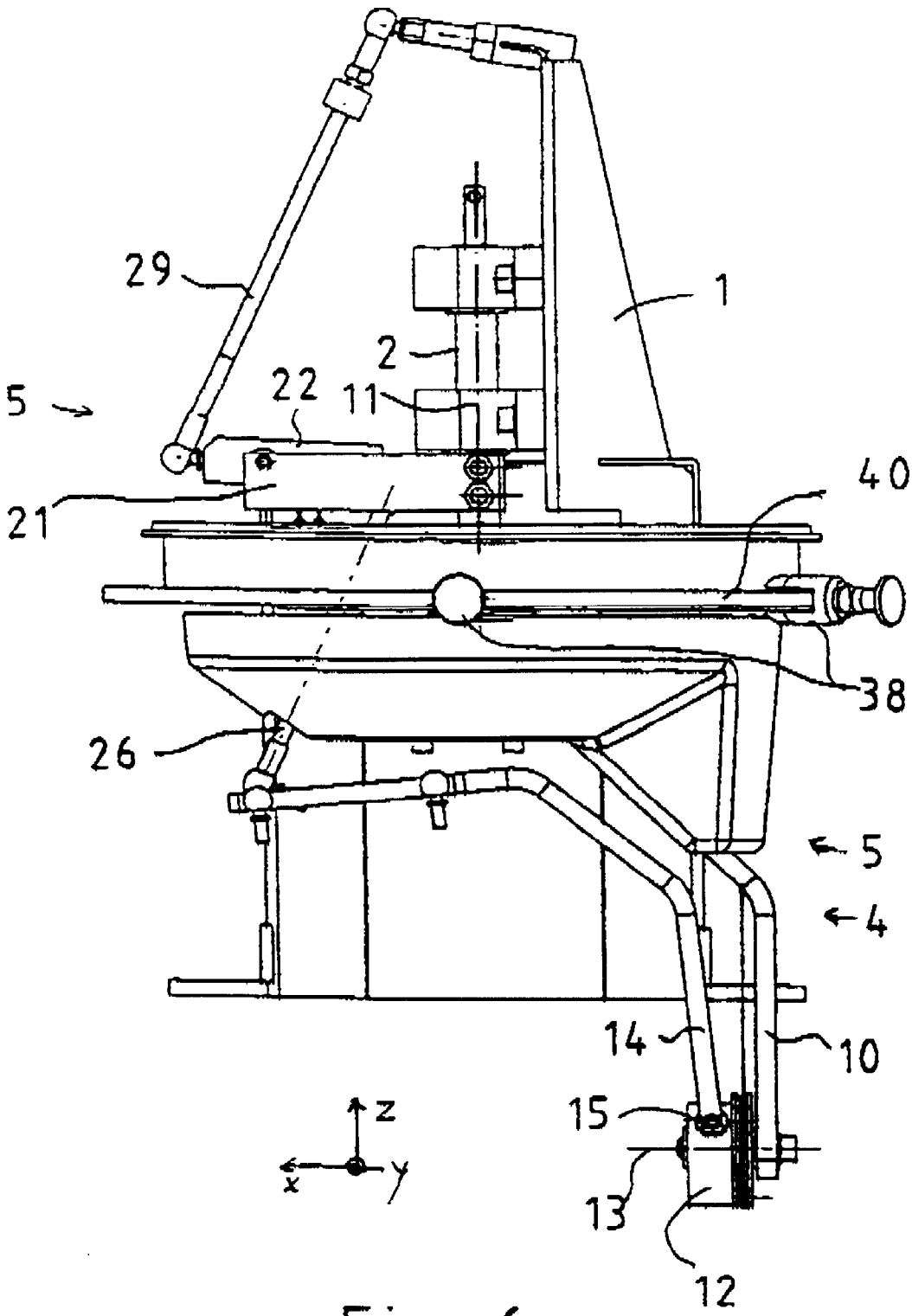
FIG. 6 presents a side view of the turning and control gear of the head rest element (not shown in the figure) of the apparatus in FIG. 4.

The apparatus comprises a turning arbor 2 which is mounted on the equipment frame 1 with bearings allowing rotation about the vertical z-axis. In FIGS. 4–6, the turning arbor 2 is diagrammatically represented by a broken line. The head rest element 3 is a helmet into which a person inserts his/her head so that the helmet 3 remains immobile relative to the head during the rotation exercise movement, in other words, the helmet 3 follows the motion of the head. The helmet 3 is connected to the turning arbor 2 via a turning device 4 acting as a kind of universal joint so that the helmet 3 can simultaneously turn about three axes perpendicular to each other. This turning motion is so controlled by means of a control gear 5 that it follows the natural three-dimensional motional pattern of head rotation. The control gear 5 controls the turning of the head rest element attached to the turning device as function of the angle of rotation of the turning arbor 2 so that the head rest element 3 will turn in the xyz-space simultaneously about the x, y and z axes.

Figure 7:
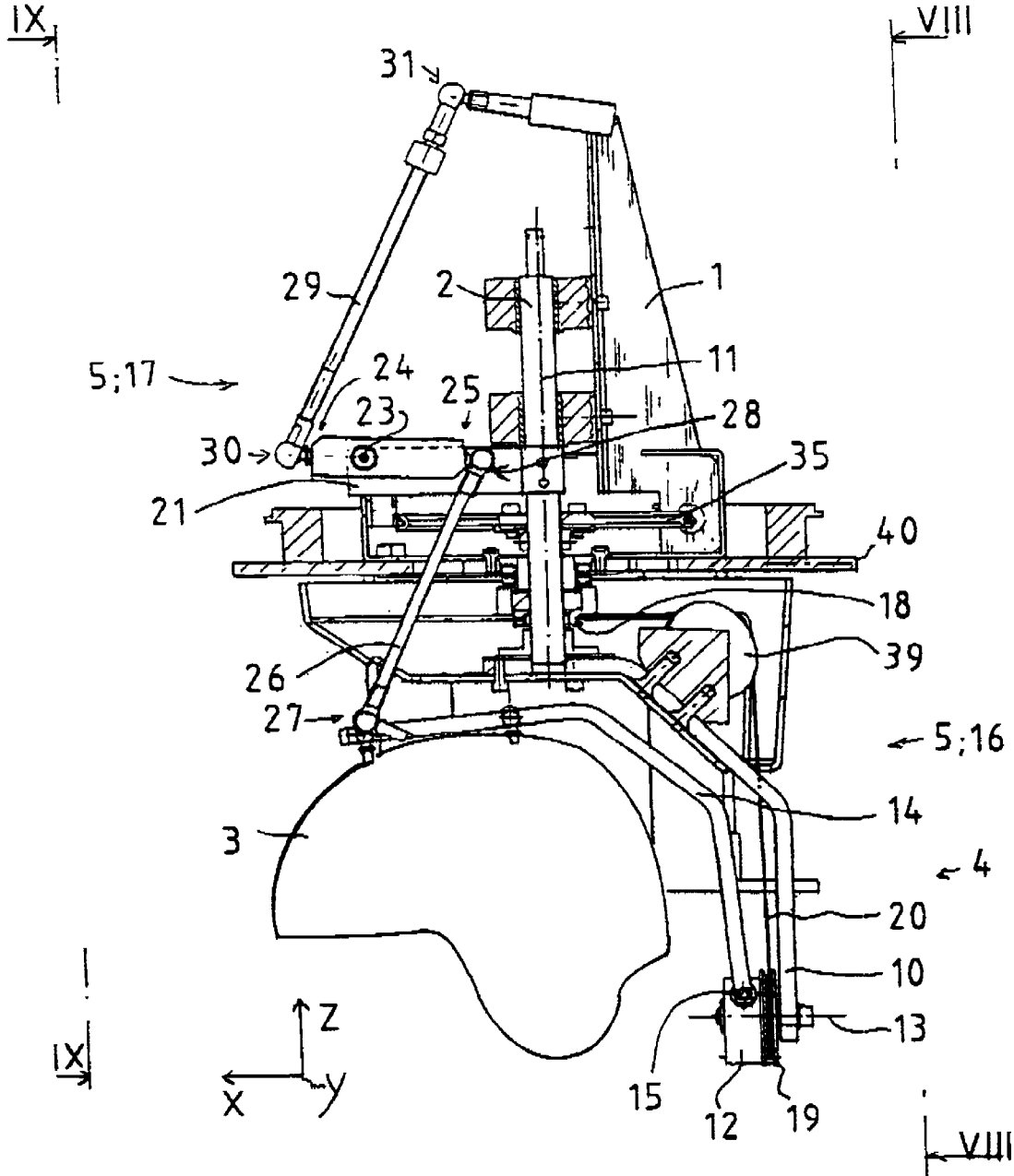
FIG. 7 is a vertical section through the device in FIG. 6

The structure and function of the turning device 4 and control gear 5 are illustrated by FIGS. 6–9, the cross-sectional view in FIG. 7 being the most illustrative. The vertical turning arbor 2 is rotatably mounted with bearings on the equipment frame 1. The turning device 4 comprises a first frame 10, which is attached to the lower end of the turning arbor 2 so that it can turn with the turning arbor 2 about a first swing axis 11 parallel to the z-axis. A second frame 12 is pivotally mounted on the first frame 10 so that it can turn about a second swing axis 13 parallel to the x-axis. A third frame 14 is pivotally mounted on the second frame 12 so that it can turn about a third swing axis 15, which is disposed near the second swing axis 15, which is disposed near the second swing axis 13 in a direction perpendicular to it. The helmet is attached to the third frame 14.

The first frame 10 extends downward and backward from the turning arbor 2 to a point behind the head rest element 3 so that it extends behind the neck of the person having his/her head in the helmet 3. The second frame 12 is pivotally mounted on the aforesaid part of the first frame 10 extending behind the head rest element, so that the second swing axis 13 lies in the vertical centre plane of symmetry T of the head rest element (see FIG. 8).

Figure 8:
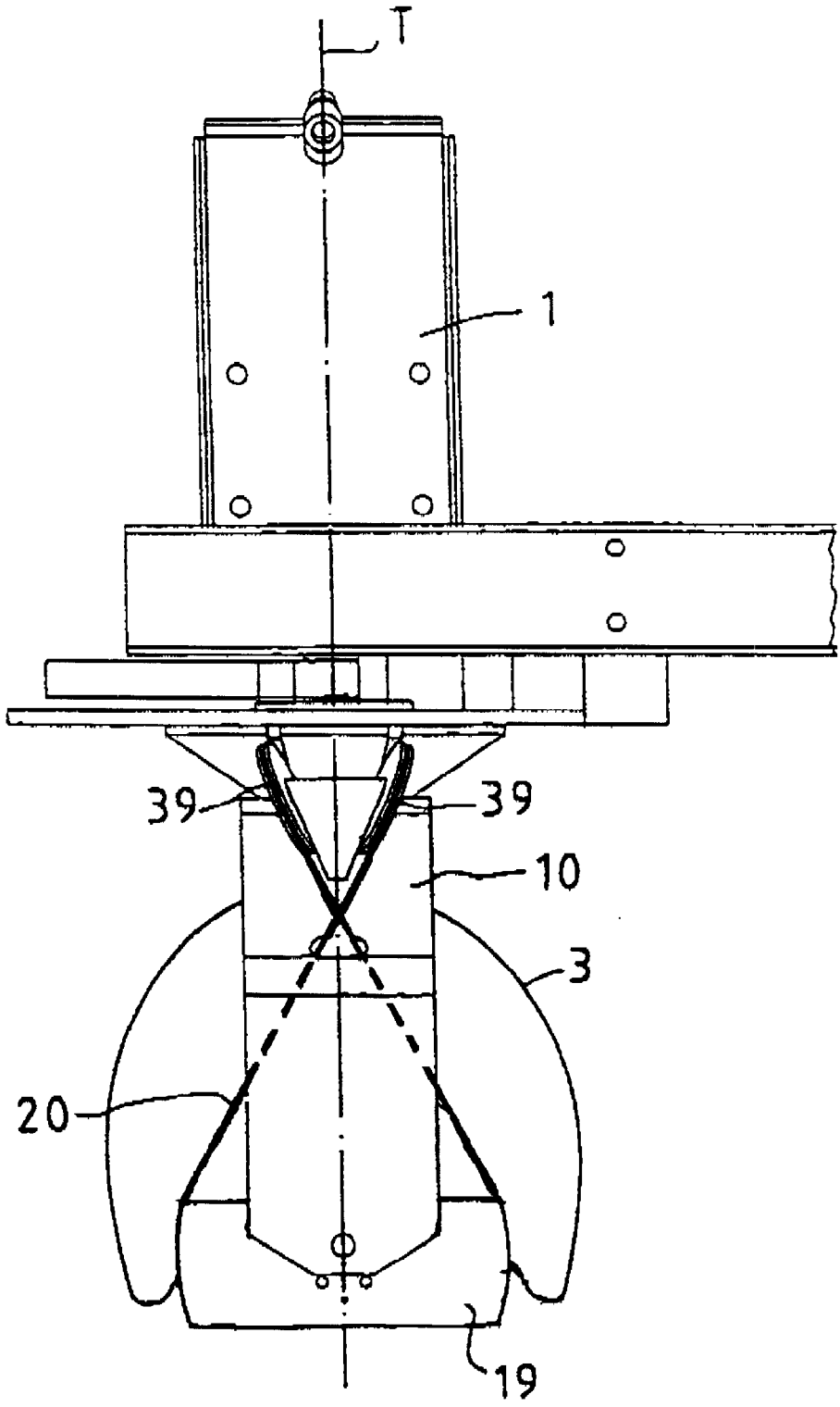
FIG. 8 presents the device in FIG. 7 as seen from the direction VIII—VIII.
Figure 9:
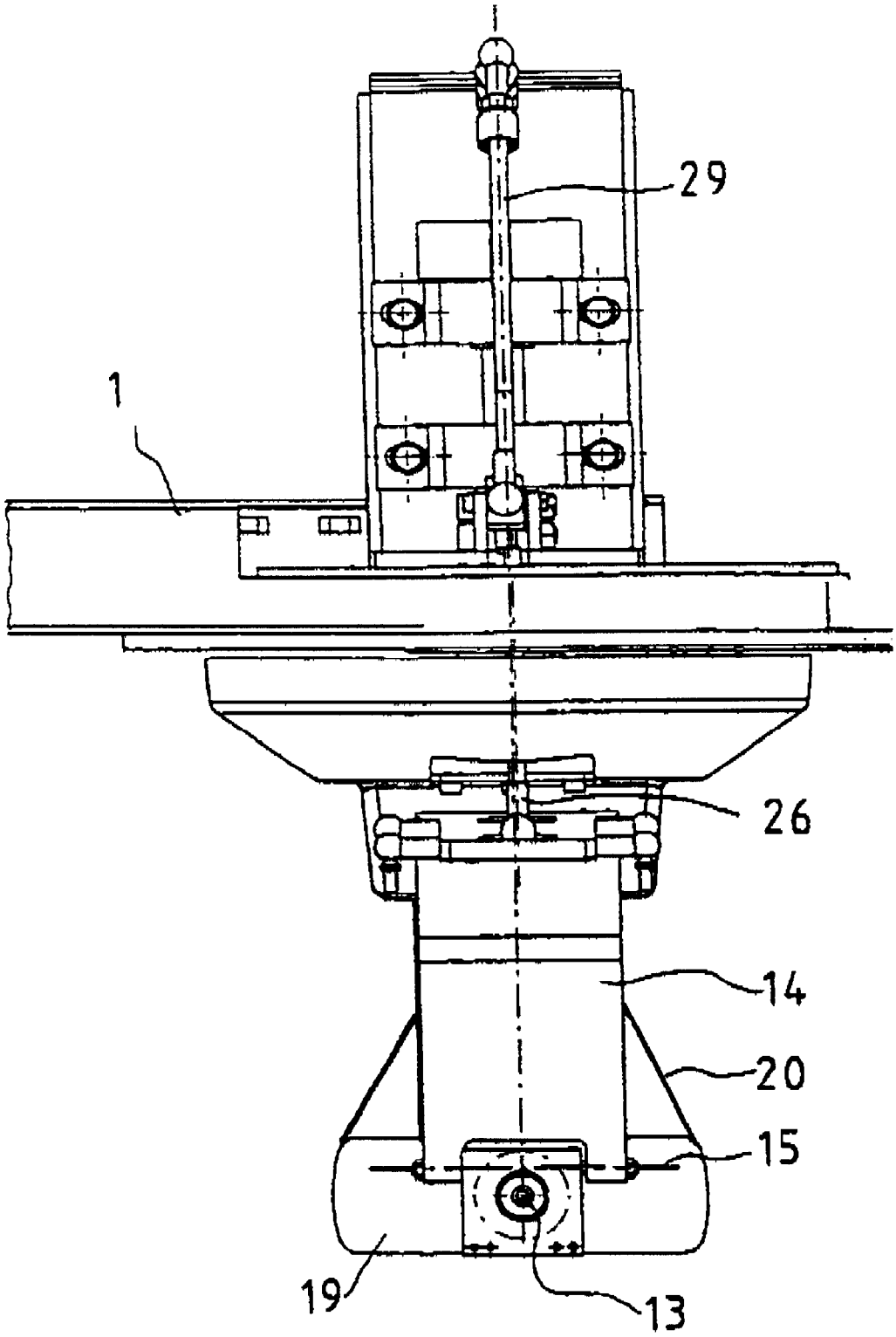
FIG. 9 presents the device in FIG. 7 as seen from the direction IX—IX (without the head rest element)

The control gear 5 comprises a first set of transmission elements 16 for turning the second frame 12 about the second swing axis 13 parallel to the x-axis in relation to the first frame 10 with a predetermined first transmission ratio when the turning arbor 2 is turning about the first swing axis 11 parallel to the z-axis. The first set of transmission elements 16 comprises a first turning element 18, which in this case is a kind of pulley or the like and is attached to the turning arbor 2, and a second transmission element 19, which is also a kind of pulley or the like and is attached to the second frame 12. A flexible elongated draw element 20, a wire 20, is attached to the first and second turning elements 18 and 19 to transmit the rotary motion of the turning arbor 2 so as to turn the second frame with respect to the first frame 10. The wire 20 forms a closed transmission loop between the pulleys 18 and 19 so that turning one of them forces the other to turn also. As shown in FIGS. 7 and 8, as the swing axes 11 and 13 of the turning elements 18 and 19 are perpendicular to each other, the first set of transmission elements 16 additionally comprises two diverting pulleys 39 attached to the first frame 10 for guiding the wire 20. FIG. 8 shows how the wire 20 runs in a crosswise manner. As a result of this arrangement, the helmet 3 is tilted sideways in the same direction with the rotation.

Further referring to FIG. 7, the control gear 5 comprises a second set of transmission elements 17, which serves to produce a forward inclination of the helmet 3 simultaneously with rotation and sideways tilting as described above. Therefore, the second set of transmission elements 17 turns the frame 14 with the helmet 3 attached to it about the third swing axis 15 parallel to the y-axis with a predetermined second transmission ratio when the turning arbor 2 is turning about the first swing axis 11 parallel to the z-axis.

The above-mentioned second set of transmission elements 17 comprises a projection 21 fixedly attached to the turning arbor 2 so that when the turning arbor 2 is turned, the projection 21 will turn with it. The projection 21 extends in a transverse direction from the turning arbor 2. A rocking arm 22 is pivotally connected via a joint 23 in its mid portion to the projection 21 so that it can turn about a horizontal axis. The rocking arm 22 comprises a front end 24, which is on the front side of the joint 23, and a rear end 25, which is on the rear side of the joint 23. The lower end 27 of a first rod 26 is connected via a ball joint to the third frame 14, to which the helmet 3 is attached, while the upper end 28 of the first rod 26 is connected via a ball joint to the rear end 25 of the rocking arm 22. The lower end 30 of a second rod 29 is connected via a ball joint to the front end 24 of the rocking arm 22 and the upper end 31 of the second rod 29 is connected via a ball joint to the fixed equipment frame 1.

Thus, the second set of transmission elements works as follows. When the head in the helmet 3 is turned sideways, the turning arbor 2 turns about the first swing axis 11. The second rod 29 swings about its fulcrum at the upper end and raises the front end 24 of the rocking arm 22. The rocking arm 22 turns about its fulcrum 23, forcing the first rod 26 pivoted on its rear end 25 to move downward and pushing the third frame 14 and the helmet 3 attached to it downward, causing the third frame 14 to turn about its hinge link axis 15 and producing a forced forward inclination of the helmet 3 and the head inside it. This inclination takes place simultaneously with the sideways tilting of the helmet described above. All the above-mentioned movements are performed in certain proportions to each other, determined by the transmission ratios. The apparatus allows rotation exercise movements both to the right and to the left.

As is further shown in FIGS. 6 and 7, the apparatus comprises adjustable limit stops 38 for adjustment of the permitted range of exercise movement. Fixed to the equipment frame 1 is a circular plate 40, which thus remains stationary. The limit stops 38 can be set and secured to desired points on the plate 40. Correspondingly, attached to the structure rotating with the turning arbor 2 is a pin or the like (not shown) which meets the limit stops 38 when the turning arbor 2 is being turned.

Figure 10:
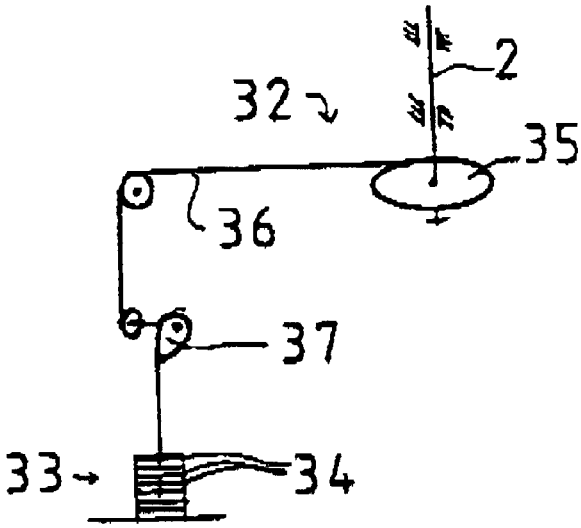
FIG. 10 presents a diagrammatic illustration of the principle of a counterforce element

FIG. 10 further presents a diagram representing an example of how a force opposing the exercise movement can be produced. For this purpose, the apparatus comprises a resistance means 32 acting to generate a torque opposing the rotation of the turning arbor 2. The resistance means 32 functions on the principle of passive gravitational resistance. The resistance means 32 comprises a counterweight 33, which consists of a number of individual weight elements 34 of a given weight, which can be combined so as to create a predetermined load. The resistance means 32 comprises a third wheel 35 connected to the turning arbor 2 and a flexible elongated second draw element 36, e.g. a wire 36, for transmitting the load of the counterweight 33 to the third wheel 35. Furthermore, the resistance means 32 comprises an eccentric gear 37 arranged to act between the second draw element 36 and the counterweight 33 so that a load opposing the exercise movement with a force varying in a predetermined manner as a function of the angle of rotation of the turning arbor 2 is created.

The invention is not restricted to the examples of its embodiments described above, but instead many variations are possible within the scope of the inventive idea defined in the claims.

What is claimed is:

1. Apparatus for exercising muscles around a cervical spine or a motional pattern of the cervical spine with a rotation exercise movement of a person's head, said apparatus comprising:

an equipment frame;

a turning arbor mounted on the equipment frame with bearings permitting rotation of the arbor about a vertical axis;

a head rest element for holding the head, said head rest element being connected to the turning arbor and comprising means for holding the head of the person performing the exercise movement substantially immobile in the head rest element;

a turning device connecting the head rest element to the turning arbor so as to allow simultaneous turning of the head rest element about three axes comprising an x-axis, a y-axis, and a z-axis, said axes being perpendicular to each other;

the turning device comprising a first frame attached to the turning arbor and turning therewith about a vertical first swing axis; a second frame pivotally mounted on the first frame and turning about a second swing axis parallel to the x-axis; and a third frame pivotally mounted on the second frame and turning about a third swing axis parallel to the y-axis; said third swing axis being disposed near and perpendicular to the second swing axis; the head rest element being attached to said third frame;

a control gear arranged to control the turning of the head rest element so that the head rest element turns about said axes in a predetermined proportion to the angle of rotation of the turning arbor; and said control gear comprising a first set of transmission elements for turning the second frame about the second swing axis parallel to the x-axis in relation to the first frame with a predetermined first transmission ratio when the turning arbor is turning about the first swing axis parallel to the z-axis.

2. The apparatus according to claim 1, further comprising a seat provided with a back rest; holding means for holding the person's torso against the back rest; and adjusting elements for adjusting the position of the seat in relation to the equipment frame.

3. The apparatus according to claim 1, wherein the head rest element is a helmet having an interior space for receiving the person's head.

4. The apparatus according to claim 1, wherein the first frame extends downward and backward from the turning arbor to a point behind the head rest element; and the second frame is pivotally mounted on a part of the first frame extending behind the head rest element, so that the second swing axis lies in a vertical center plane of symmetry of the head rest element.

5. The apparatus according to claim 1, wherein the control gear comprises a second set of transmission elements for turning the third frame about the third swing axis parallel to the y-axis with a predetermined second transmission ratio when the turning arbor is turning about the first swing axis parallel to the z-axis.

6. The apparatus according to claim 1, wherein the first set of transmission elements comprises a first turning element attached to the turning arbor; a second transmission element attached to the second frame; and a flexible elongated draw element attached to the first and second turning elements to transmit the rotary motion of the turning arbor so as to turn the second frame with respect to the first frame.

7. The apparatus according to claim 5, wherein the second set of transmission elements comprises a projection attached to the turning arbor and extending in a substantially transverse direction from the turning arbor; a rocking arm pivotally connected via a first joint in its mid portion to the projection so that the rocking arm can turn about a horizontal axis, said rocking arm comprising a front end on a front side of the first joint, and a rear end on a rear side of the first joint; a first rod having a lower end connected via a second joint to one of the third frame and the head rest element, and an upper end connected via a third joint to the rear end of the rocking arm; and a second rod having a lower end connected via a fourth joint to the front end of the rocking arm, and an upper end connected via a fifth joint to the equipment frame.

8. The apparatus according to claim 7, wherein the second, third, fourth and fifth joints are ball joints.

9. The apparatus according to claim 1, further comprising a resistance member for producing a force opposing the rotation exercise movement.

10. The apparatus according to claim 9, wherein the resistance member is connected to the turning arbor to generate a torque opposing the rotation of the turning arbor.

11. The apparatus according to claim 9, wherein the resistance member operates on the principle of gravitational resistance, and comprises a counterweight having a number of individual weight elements which can be combined to produce a predetermined load.

12. The apparatus according to claim 11, wherein the resistance member comprises a wheel connected to the turning arbor, and a flexible elongated second draw element for transmitting the load of the counterweight to the wheel.

13. The apparatus according to claim 11, wherein the resistance member comprises an eccentric gear arranged to act between a second draw element and the counterweight to create a load opposing the exercise movement with a force varying in a predetermined manner as a function of the angle of rotation of the turning arbor.

14. The apparatus according to claim 1, further comprising adjustable limit stops for adjustment of the permitted range of exercise movement.

* * * * *